US009138874B2

(12) United States Patent
Lin

(10) Patent No.: US 9,138,874 B2
(45) Date of Patent: Sep. 22, 2015

(54) OPEN WRENCH

(71) Applicant: Chen-Wei Lin, Taichung (TW)

(72) Inventor: Chen-Wei Lin, Taichung (TW)

( * ) Notice: Subject to any disclaimer, the term of this patent is extended or adjusted under 35 U.S.C. 154(b) by 281 days.

(21) Appl. No.: 13/869,039

(22) Filed: Apr. 24, 2013

(65) Prior Publication Data

US 2014/0318326 A1 Oct. 30, 2014

(51) Int. Cl.
*B25B 13/46* (2006.01)
*B25B 13/08* (2006.01)

(52) U.S. Cl.
CPC ..... *B25B 13/46* (2013.01); *B25B 13/08* (2013.01)

(58) Field of Classification Search
CPC ..... B25B 13/08; B25B 13/10; B25B 13/12; B25B 13/46
USPC ..... 81/179, 186
See application file for complete search history.

(56) References Cited

U.S. PATENT DOCUMENTS

| | | | | |
|---|---|---|---|---|
| 3,165,015 | A * | 1/1965 | Hinrichs | 81/179 |
| 3,717,054 | A * | 2/1973 | Thompson | 81/179 |
| 8,381,620 | B1 * | 2/2013 | Cheng | 81/179 |
| 8,887,600 | B2 * | 11/2014 | Chen | 81/179 |
| 2007/0119281 | A1 * | 5/2007 | Chang | 81/179 |
| 2009/0272236 | A1 * | 11/2009 | Tuan-Mu | 81/179 |

* cited by examiner

*Primary Examiner* — Hadi Shakeri

(57) ABSTRACT

An open wrench includes a body having a mounting hole which is partially defined by a first side face which has a curved reception recess and a cavity which communicates with the reception recess. A protrusion is formed at the intersectional area between the cavity and the reception recess. A first contact face is located in opposite to the first side face of the mounting hole so as to contact one side of the object. A second distance is defined between the reception recess and the first contact face. The second distance is larger than the diametrical distance of two corners of the object. A slide is located in the cavity and a resilient member is located in the cavity to bias the slide which partially protrudes from the cavity. The slide is restricted from dropping from the cavity by the protrusion. The slide contacts the object.

6 Claims, 12 Drawing Sheets

OPEN WRENCH

FIELD OF THE INVENTION

The present invention relates to an open wrench, and more particularly, to an one wrench with a slide movable in the opening so as to use the open wrench as a ratchet wrench.

BACKGROUND OF THE INVENTION

The conventional open wrench is disclosed in U.S. Pat. No. 3,023,654 and generally comprises a body having a head and a first recess is defined in the head. A stop is formed at the opening of the first recess which has a threaded portion, having inner threads, at the end portion of the first recess.

A slide is located in the second recess and has a contact portion which protrudes from the opening of the body. The contact portion has a sliding portion which is matched with the shaped of the first recess. The sliding portion has a rod at the lower end thereof.

A locking member is located in the first recess and has outer threads which are threadedly connected to the threaded portion of the first recess. A passage is defined through the locking member and the rod of the slide is inserted into the passage.

A resilient member is mounted to the rod of the slide and contacts between the sliding portion and the locking member to allow the slide movable in the first recess to perform as a ratchet wrench.

However, the slide, the resilient member, the locking member and the threaded portion in the body are necessary to allow the slide to be movable in the first recess. There are more than three parts required and the threaded portion has to be made by extra work. The inner diameter of the first recess is small and the threads are different to be manufactured. The manufacturing cost is high.

The slide in the first recess is biased by the resilient member and is prevented from dropping from the first recess by the stop at the opening of the first recess. The position where the stop is set is difficult to be decided. The stop has to be set at the position where the contact portion of the slide is exposed beyond the opening and located adjacent to the object to be tightened or loosened. If the stop is located deep inside of the first recess, the contact portion cannot contact the object which is not able to be rotated effectively. If the stop is located at too shallow in the first recess, the contact portion protrudes too much from the opening so that the object has to push the contact portion backward.

When the stop has a smaller portion protruding from the opening, and the manufacturers need to cut a portion of the stop and this work is difficult. Generally, the maximum thickness that can be cut is 0.5 mm and this requires precise machining skill. If the whole wrench is deemed as a defective product, the lost of expense is too high.

The present invention intends to provide an open wrench with a slide to perform as a ratchet wrench and the present invention improve the shortcomings of the conventional wrenches.

SUMMARY OF THE INVENTION

The present invention relates to an open wrench and comprises a body 10 having a mounting hole defined in a head thereof and the mounting hole is partially defined by a first side face 11 which has a curved reception recess 111 defined therein. A cavity 112 is defined in the first side face 11 and communicates with the reception recess 111. At least one protrusion 113 is formed at intersectional area between the cavity 112 and the reception recess 111. A first contact face 12 is located in opposite to the first side face 11 of the mounting hole and is a curved convex face or a flat face. The first contact face 12 has a recessed area 13 defined therein which is located close to a handle of the wrench. The recessed area 13 accommodates a corner of an object in the mounting hole. The first contact face 12 contacts one side of the object. A second contact face 14 and a third contact face 15 are located between the cavity 112 and the first contact face 12. Each of the second contact face 14 and the third contact face 15 is a curved convex face or a flat face. The recessed area 13 is located between the first and third contact faces 12, 15. The first side face 11, the first, second and third contact faces 12, 14, 15 contact four adjacent sides of the object. A first distance 114 is defined between the first side face 11 and the first contact face 12. A second distance 115 is defined between the reception recess 111 and the first contact face 12. The second distance 115 is larger than the diametrical distance of two corners of the object. A first angle 116 is defined between the horizontal line of the body 10 and the central axis of the cavity 112. A slide 20 is located in the cavity 112 of the body 10 and has an outer surface 21. A resilient member 30 is located in the cavity 112 of the body 10 and biased between the inside of the cavity 112 and the slide 20. The resilient member 30 biases the slide 20 to partially protrude from the cavity 112. The slide 20 is restricted from dropping from the cavity 112 by the at least protrusion 113. The first side face 11 and the protruding slide 20 contact one side of the object. The first contact face 12 contacts another side of the object. The second and third contact faces 14, 15 contact two adjacent sides of the object.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
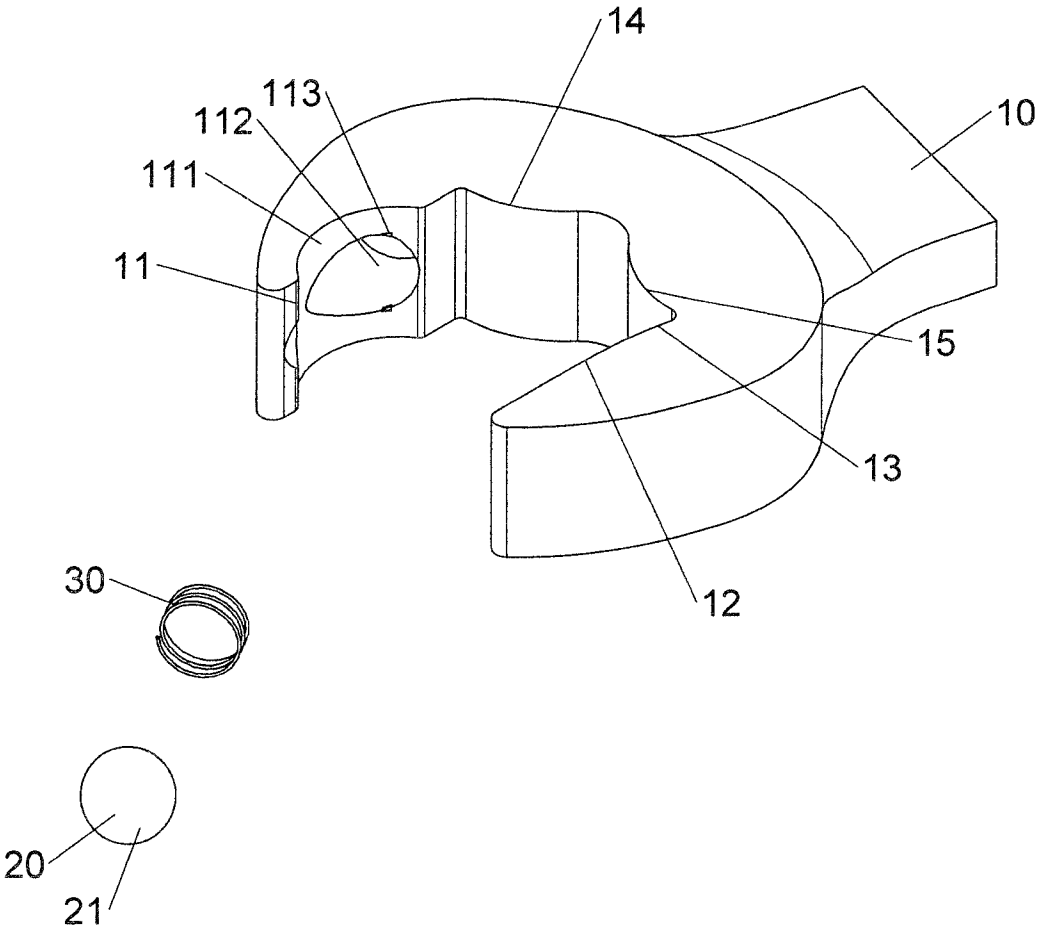
FIG. 1 is an exploded view to show the open wrench of the present invention.
Figure 2:
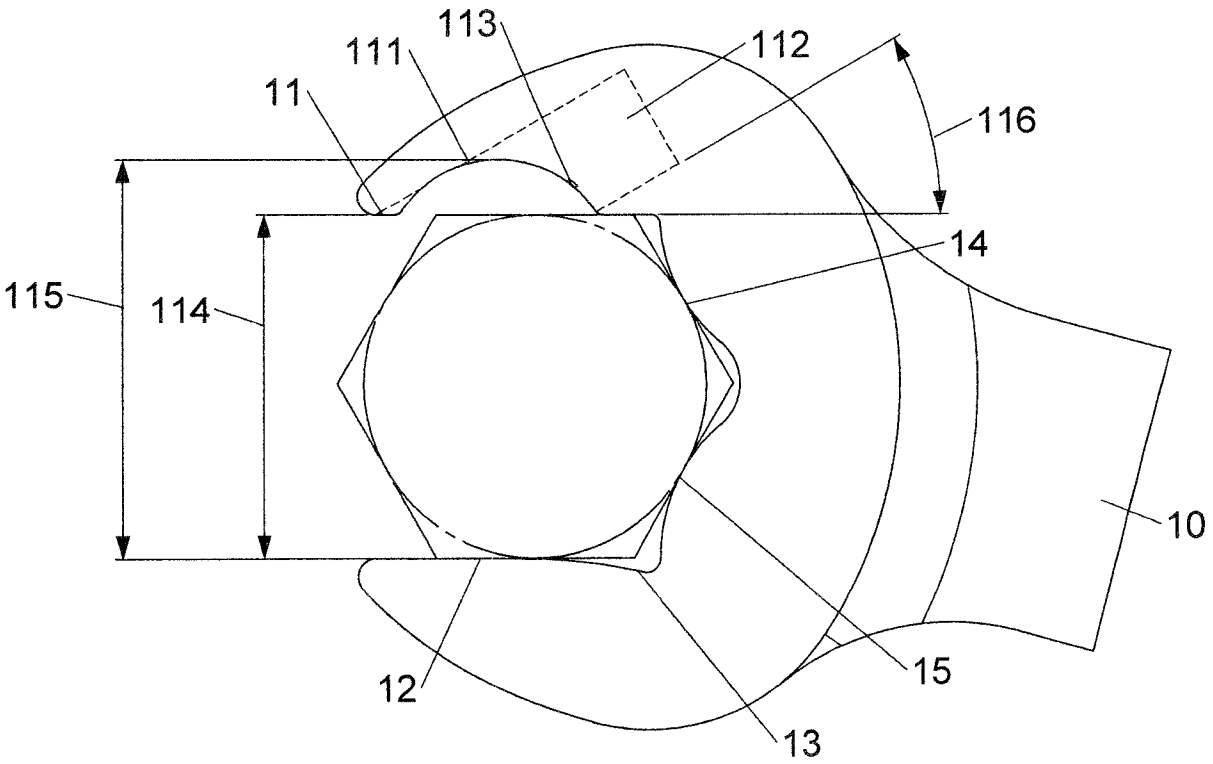
FIG. 2 is a top view to show the open wrench of the present invention.

Referring to FIGS. 1 and 2, the open wrench of the present invention comprises a body 10 having a mounting hole defined in the head thereof and the mounting hole is partially defined by a first side face 11 which has a curved reception recess 111 defined therein. A cavity 112 is defined in the first side face 11 and communicates with the reception recess 111. The cavity 112 does not go through the body 10 and at least one protrusion 113 is formed at the intersectional area between the cavity 112 and the reception recess 111 by way of pressing. In this embodiment, there are two or three protrusions 113 which are arranged in a circle. A first contact face 12 is located in opposite to the first side face 11 of the mounting hole and is a curved convex face or a flat face. The first contact face 12 has a recessed area 13 defined therein which is located close to a handle of the wrench. The recessed area 13 accommodates a corner of an object 50 in the mounting hole. The first contact face 12 contacts one side of the object. A second contact face 14 and a third contact face 15 are located between the cavity 112 and the first contact face 12. Each of the second contact face 14 and the third contact face 15 is a curved convex face or a flat face. The recessed area 13 is located between the first and third contact faces 12, 15. The first side face 11, the first, second and third contact faces 12, 14, 15 contact four adjacent sides of the object 50. The first side face 11, the first, second and third contact faces 12, 14, 15 enclose a hexagonal area. A first distance 114 is defined between the first side face 11 and the first contact face 12. A second distance 115 is defined between the reception recess 111 and the first contact face 12. The second distance 115 is larger than the diametrical distance of two corners of the object 50. A first angle 116 is defined between the horizontal line of the body 10 and the central axis of the cavity 112. A slide 20 is located in the cavity 112 of the body 10 and has an outer surface 21. The first angle 116 is between 10 degrees to 40 degrees. Preferably, the first angle 116 is between 15 degrees to 35 degrees. In this embodiment, the first angle 116 is 30 degrees.

A slide 20 is located in the cavity 112 of the body 10. In this embodiment, the slide 20 is a bead and has an outer surface 21.

A resilient member 30 is located in the cavity 112 of the body 10 and biased between the inside of the cavity 112 and the slide 20. The resilient member 30 biases the slide 20 to partially protrude from the cavity 112. The slide 20 is restricted from dropping from the cavity 112 by the at least protrusion 113.

Figure 4:
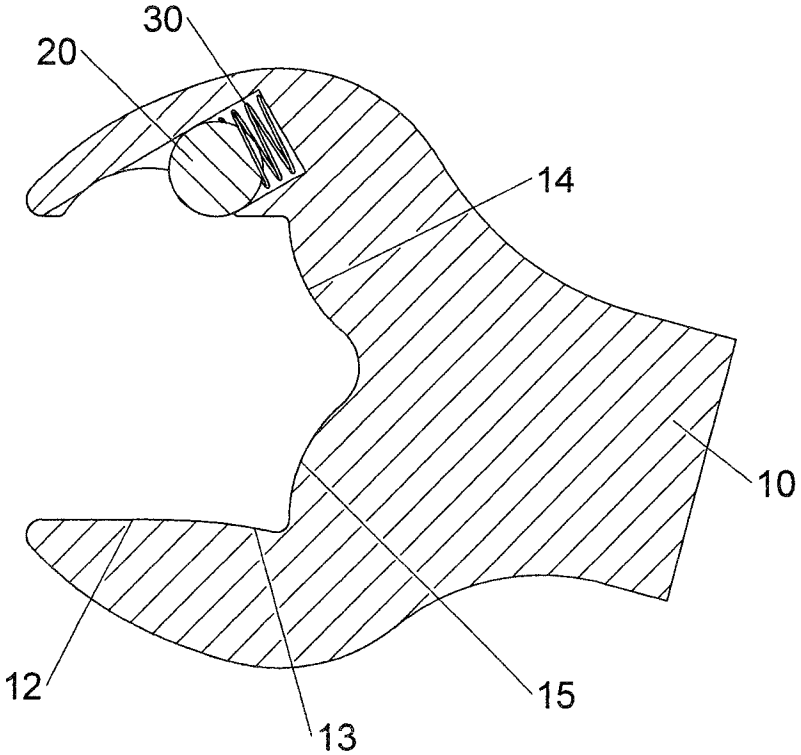
FIG. 4 is a cross sectional view taken along ling A-A in FIG. 3.
Figure 3:
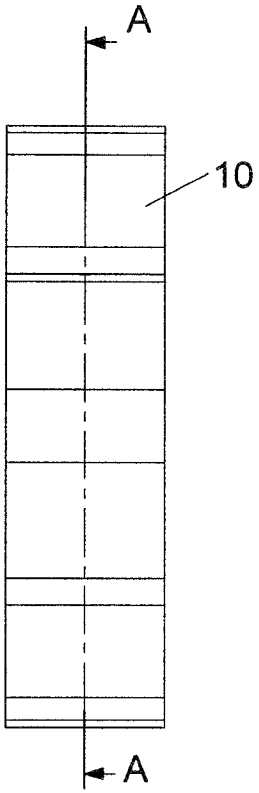
FIG. 3 is a side view to show the open wrench of the present invention.
Figure 5:
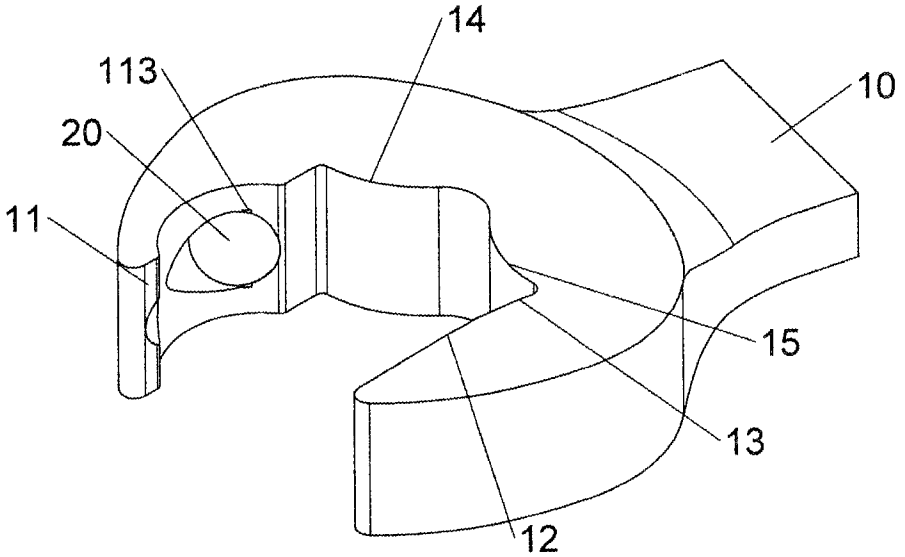
FIG. 5 is a perspective view to show the open wrench of the present invention.

As shown in FIGS. 3 to 5, the resilient member 30 is located in the cavity 112 and the slide 20 is then put in the cavity 112. A machine is used to press an opening of the cavity 112 to form the at least one protrusion 113 at the intersectional area between the cavity 112 and the reception recess 111.

Figure 7:
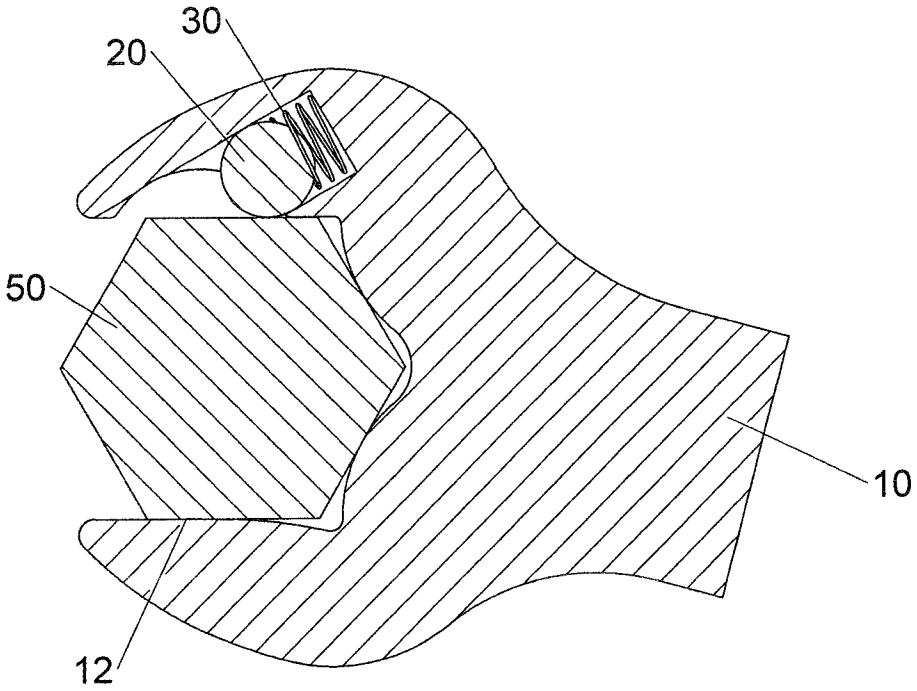
FIG. 7 is a cross sectional view taken along ling A-A in FIG. 6.
Figure 6:
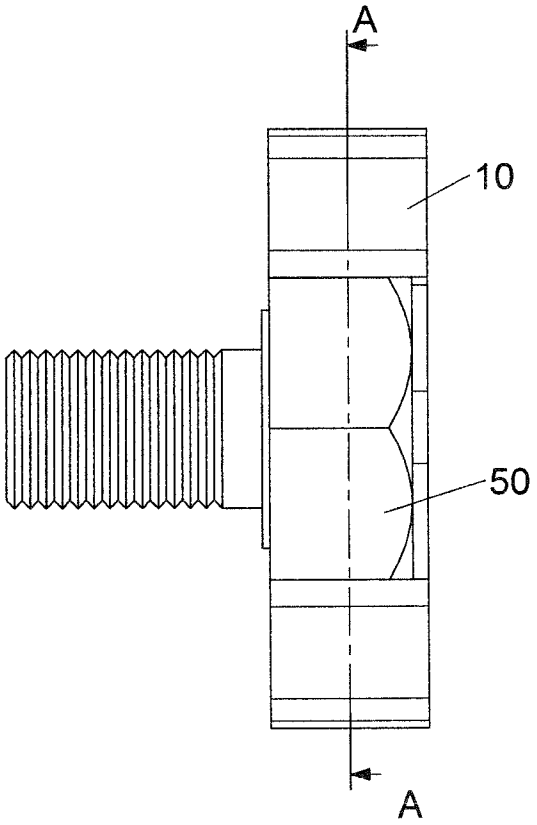
FIG. 6 is a side view to show that the open wrench of the present invention is mounted to an object.

As shown in FIGS. 6 and 7, the resilient member 30 provides the slide 20 to be movable in the cavity 112. The first side face 11 and the outer surface 21 of the slide 20 contact one side of the object 50. The first contact face 12 contacts another side of the object. The second and third contact faces 14, 15 contact two adjacent sides of the object. The recessed area 13 accommodates one corner of the object 50. There are four sides of the object 50 to be contact with the open wrench so that the object 50 can be rotated by rotating the open wrench.

Figure 8:
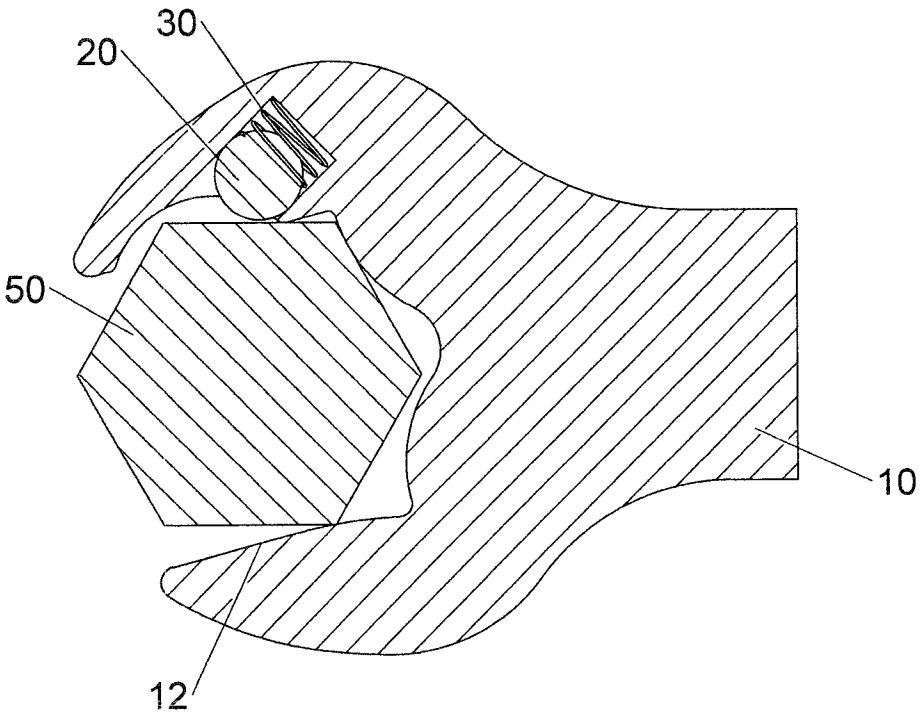
FIG. 8 shows the first return position of the open wrench of the present invention.
Figure 9:
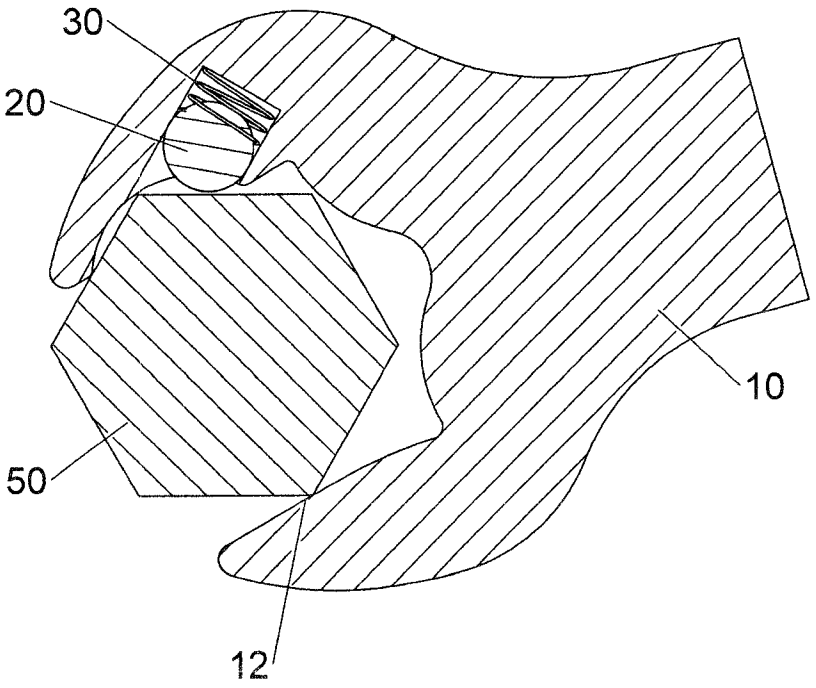
FIG. 9 shows the second return position of the open wrench of the present invention.
Figure 10:
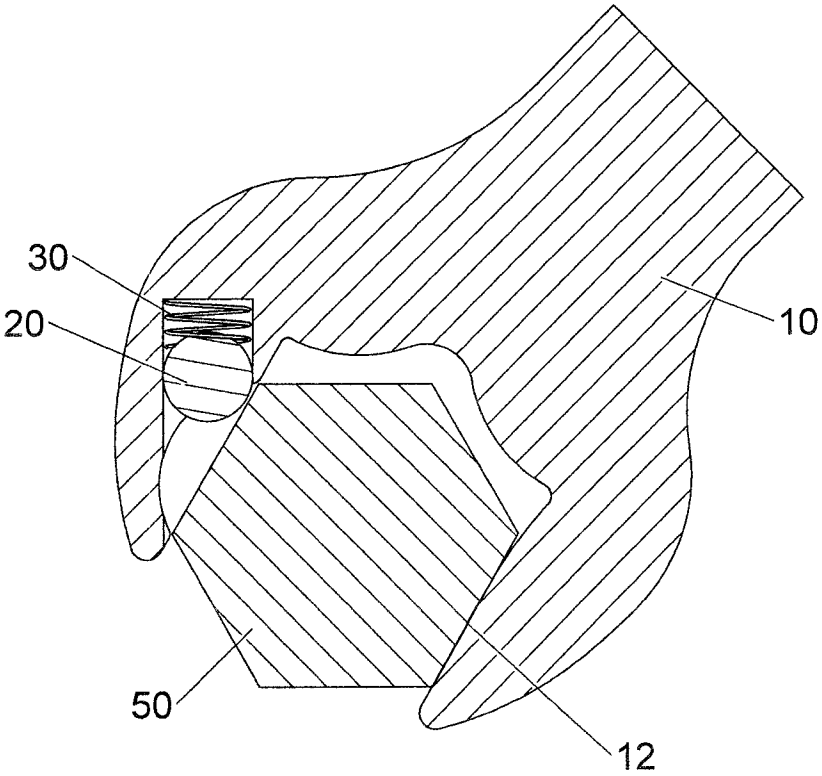
FIG. 10 shows the third return position of the open wrench of the present invention.

As shown in FIGS. 8 to 10, when the wrench rotates clockwise the object 50 to an angle, the wrench is rotated counter clockwise to change the relative position between the object 50 and the mounting hole, The object 50 contacts the outer surface 21 of the slide 20 so that the resilient member 30 is compressed and the slide 20 is retracted into the cavity 112. FIG. 10 shows that the wrench is adjusted to another position relative to the object 50, the first side face 11, the first contact face 12 and the second and third contact faces 14, 15 are in contact with the next sides of the object 50. The outer surface 21 of the slide 20 biased by the resilient member 30 contacts the next side of the object 50 as shown in FIG. 7. The wrench can be rotated clockwise to rotate the object 50.

Figure 11:
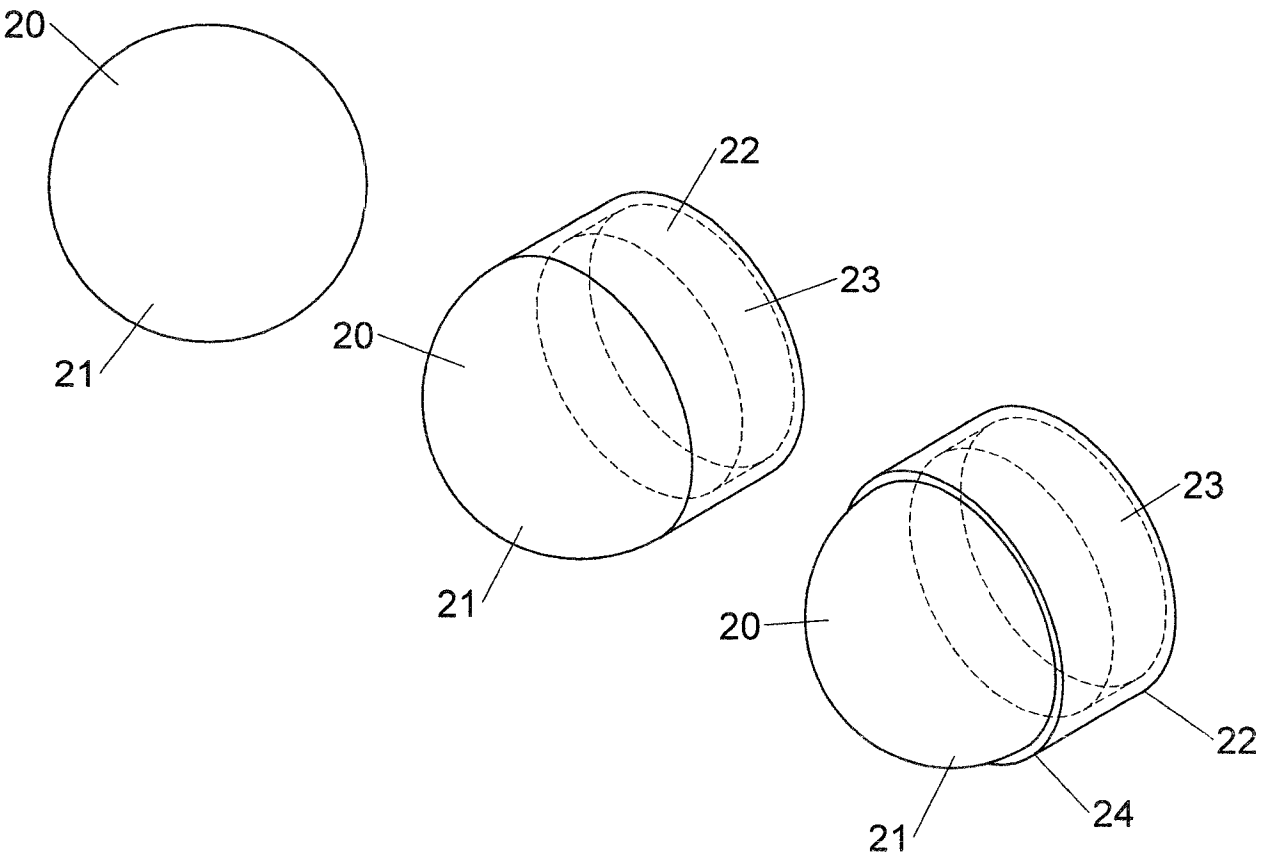
FIG. 11 shows the slide of the open wrench of the present invention.

As shown in FIG. 11, the slide 20 is a bead or the slide has a peripheral portion 22 which has a recess 23 defined therein. The resilient member 30 is biased between the recess 23 of the slide 20 and the inside of the cavity 112. Alternatively, the slide 20 has a peripheral portion 22 which has a recess 23 defined therein. The resilient member 30 is biased between the inside of the recess 23 of the slide 20 and the inside of the cavity 112. The peripheral portion 22 has a shoulder 24 formed in outside thereof and the at least one protrusion 113 contacts the shoulder 24.

Figure 12:
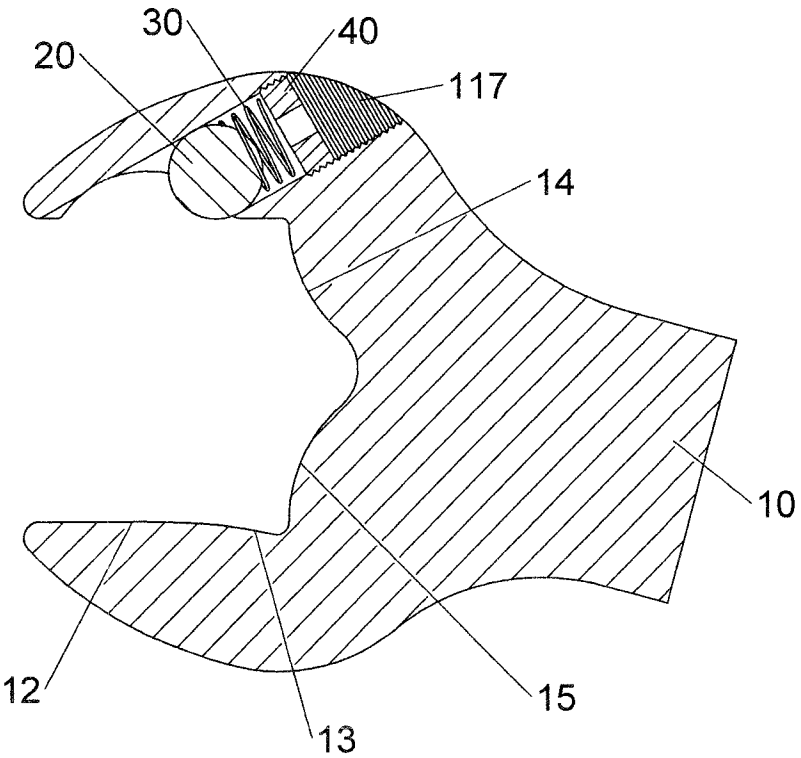
FIG. 12 is a cross sectional view of the second embodiment of the open wrench of the present invention.

As shown In FIG. 12 which shows the second embodiment of the opening wrench wherein the cavity 112 is defined through the body 10 and has a first threaded portion 117 defined therein. A locking member 40 is threadedly connected to the first threaded portion 117. The resilient member 30 is biased between the slide 20 and locking member 40.

Figure 13:
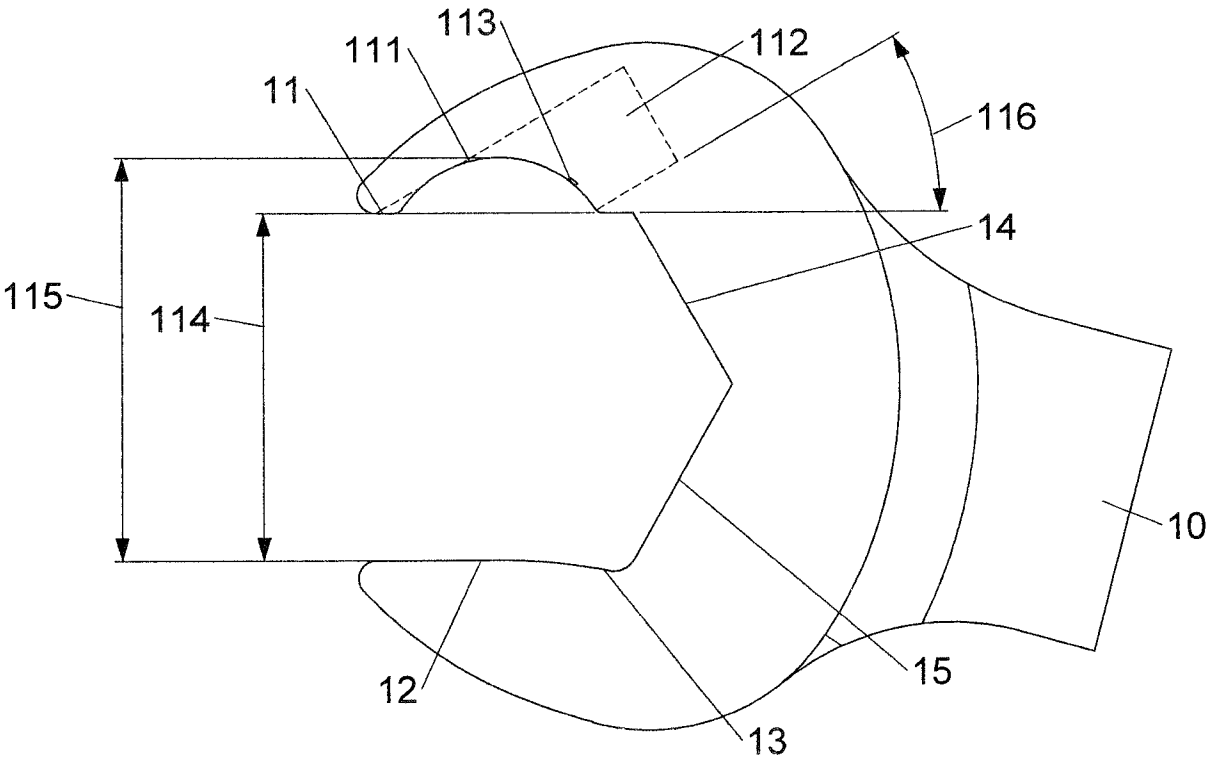
FIG. 13 is a top view of the second embodiment of the open wrench of the present invention.
Figure 16:
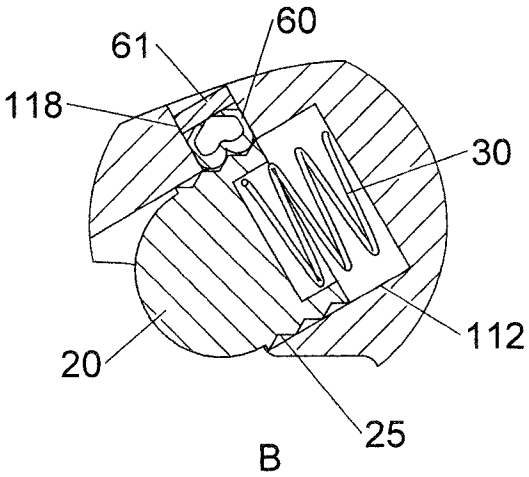
FIG. 16 is an enlarged view of the circled "B" in FIG. 15.

As shown in FIG. 13 which shows the third embodiment of the opening wrench wherein the second and third contact faces 14, 15 are a surface, and an angle of 120 degrees is defined between the second and third contact faces 14, 15.

Figure 15:
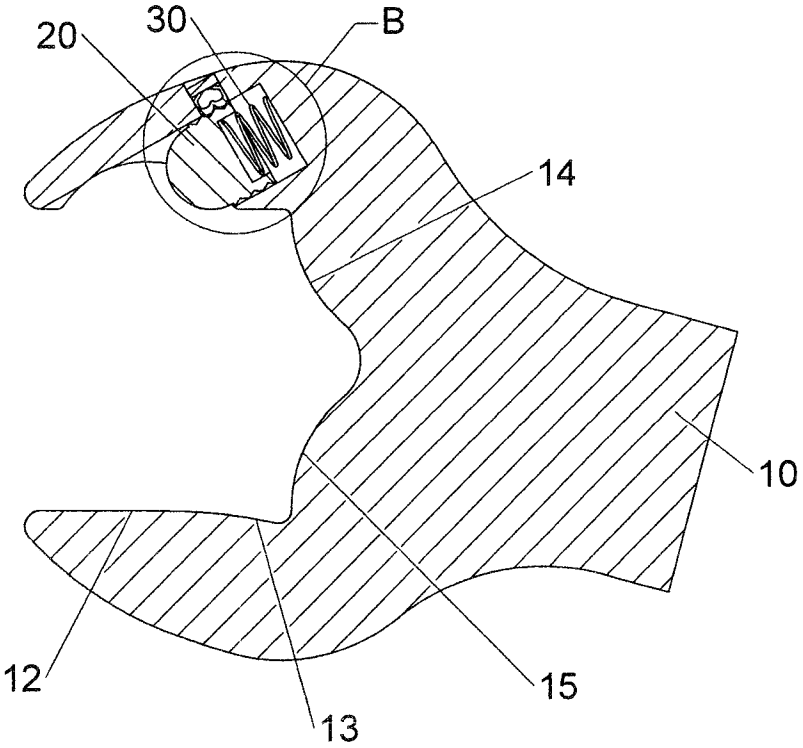
FIG. 15 is a cross sectional view taken along ling A-A in FIG. 14.
Figure 14:
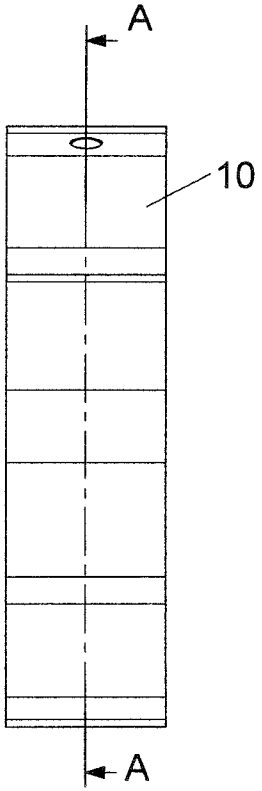
FIG. 14 is a side view of the third embodiment of the open wrench of the present invention.

As shown in FIGS. 13 to 15, the body 10 has a passage 118 which communicates with the cavity 112. The axis of the passage 118 is perpendicular to the axis of the cavity 112. The slide 20 has a peripheral portion 22 which has a recess 23 defined therein. The resilient member 30 is biased between the inside of the recess 23 of the slide 20 and the inside of the cavity 112. The peripheral portion 22 has a shoulder 24 formed in outside thereof and the at least one protrusion 113 contacts the shoulder 24. The peripheral portion 22 has a toothed portion 25. A biasing plate 60 is located in the passage 118. A sealing member 61 seals the passage 118. The biasing plate 60 is biased between the toothed portion 25 and the sealing member 61.

When the slide 20 is pushed by the object 50 and is retracted into the cavity 112, the toothed portion 25 move over the resilient plate 60 to generate click sound.

It is noted that the second distance 115 is larger than the diametrical distance of two corners of the object 50, so that the object 50 is allowed to be rotated within the mounting hole. The slide 20 is biased by the resilient member 30 and the outer surface 21 protrudes beyond the cavity 111, so that the outer surface 21 contacts one side of the object 50. The first contact face 12 and the second and third contact faces 14, 15 are in contact with the adjacent three sides of the object 50. There are four sides of the object 50 are in contact with the wrench so that the object 50 is rotated by rotating the wrench. When rotating the wrench in opposite direction, to change the relative position between the object 50 and the mounting hole, the resilient member 30 is compressed and the slide 20 is retracted into the cavity 112. The object 50 is then freely rotated in the mounting hole, the first side face 11, the first contact face 12 and the second and third contact faces 14, 15 are in contact with the next sides of the object 50. The outer surface 21 of the slide 20 biased by the resilient member 30 contacts the next side of the object 50 as shown in FIG. 7. The wrench can be rotated clockwise to rotate the object 50.

The open wrench of the present invention uses only the slide 20 and the resilient member 30, and the at least one protrusion 113 is pressed at the cavity 112 to perform the open wrench as a ratchet wrench. There are only two parts the slide 20 and the resilient member 30 are required, and the at least one protrusion 113 is formed by pressing reduce the manufacturing cost.

The first angle 116 is defied between the cavity 112 and the horizontal line of the body 10, so that when pressing the protrusion 113, the body 10 is put on the machine at the first angle 116, the protrusion 113 is formed at the intersection area between the cavity 112 and the reception recess 111 when the molds of the machine presses the body 10. Different molds can generate two, three, four or more protrusions 113, and the manufacturing cost is very low.

The slide 20 is a bead which can be 3 mm, 5 mm and 6 mm to be used to different slides 20. The 6-mm slide 20 is used to the wrenches of the specification 14 to 22. The 5-mm slide 20 is used to the wrench of another specification.

The outer surface 21 of the slide 20 contacts one side of the object 50, and the first contact face 12 contacts another side of the object. The second and third contact faces 14, 15 contact two adjacent sides of the object 50. There are four sides of the object 50 to be contact with the open wrench so that the object 50 can be rotated effectively.

While we have shown and described the embodiment in accordance with the present invention, it should be clear to those skilled in the art that further embodiments may be made without departing from the scope of the present invention.

What is claimed is:

1. An open wrench comprising:

a body having a mounting hole defined in a head thereof and the mounting hole partially defined by a first side face which has a curved reception recess defined therein, a cavity defined in the first side face and communicating with the reception recess, at least one protrusion formed at an intersectional area between the cavity and the reception recess, the body having a passage which communicates with the cavity;

a first contact face located in opposite to the first side face of the mounting hole and being a curved convex face or a flat face, the first contact face having a recessed area defined therein which is located close to a handle of the wrench, the recessed area adapted to accommodate a corner of an object in the mounting hole, the first contact face adapted to contact one side of the object;

a second contact face and a third contact face located between the cavity and the first contact face, each of the second contact face and the third contact face being a curved convex face or a flat face, the recessed area located between the first and third contact faces, the first side face, the first, second and third contact faces adapted to contact four adjacent sides of the object, a first distance defined between the first side face and the first contact face, a second distance defined between the reception recess and the first contact face, the second distance adapted to be larger than a diametrical distance of two corners of the object;

a slide located in the cavity of the body and having an outer surface; the slide having a peripheral portion which has a toothed portion, a biasing plate being located in the passage, a sealing member sealing the passage, the biasing plate being biased between the toothed portion and the sealing member;

a resilient member located in the cavity of the body and being biased between an inside of the cavity and the slide, the resilient member biasing the slide to partially protrude from the cavity, the slide being restricted from dropping from the cavity by the at least protrusion, and the first side face and the protruding slide adapted to contact one side of the object, the first contact face adapted to contact another side of the object, the second and third contact faces adapted to contact two adjacent sides of the object.

2. The wrench as claimed in claim 1, wherein the at least one protrusion includes two or three protrusions which are arranged along a circle.

3. The wrench as claimed in claim 1, wherein the slide is a bead.

4. The wrench as claimed in claim 1, wherein the cavity is defined through the body and has a first threaded portion defined therein, a locking member is threadedly connected to the first threaded portion, the resilient member is biased between the slide and locking member.

5. The wrench as claimed in claim 1, wherein an axis of the passage is perpendicular to an axis of the cavity.

6. The wrench as claimed in claim 1, wherein the slide has a peripheral portion which has a recess defined therein, the resilient member is biased between an inside of the recess of the slide and an inside of the cavity, the peripheral portion has a shoulder formed in outside thereof and the at least one protrusion contacts the shoulder.

* * * * *